United States Patent [19]

Chen

[11] Patent Number: 4,940,232

[45] Date of Patent: Jul. 10, 1990

[54] COMBINATION MULTIPURPOSE FRAME STRUCTURE

[76] Inventor: Darco Chen, No. 16, Chung Cheng 3rd Road, Pu Li Chen, Nantou Hsien, Taiwan

[21] Appl. No.: 350,361

[22] Filed: May 11, 1989

[51] Int. Cl.[5] ..... A63B 63/08

[52] U.S. Cl. ..... 273/1.5 R; 232/1 B; 273/411; 273/1.5 A; 273/400; 273/407

[58] Field of Search ..... 273/1.5 R, 1.5 A, 411, 273/400, 407, 408; 232/1 B

[56] References Cited

U.S. PATENT DOCUMENTS

| | | | |
|---|---|---|---|
| 2,130,820 | 9/1938 | Trumbull | 273/1.5 R |
| 3,258,266 | 6/1966 | Kamish | 273/1.5 A X |
| 3,598,406 | 8/1971 | Robinson | 273/1.5 R X |
| 3,602,504 | 8/1971 | Chapman et al. | 273/411 X |
| 3,788,642 | 1/1974 | Matras et al. | 273/1.5 R |
| 3,814,359 | 6/1974 | Powell | 273/400 X |
| 4,522,394 | 6/1985 | Broussard | 273/1.5 R |

FOREIGN PATENT DOCUMENTS

| | | | |
|---|---|---|---|
| 1341549 | 9/1963 | France | 273/1.5 R |

OTHER PUBLICATIONS

Toys to Grow on Catalog, Fall 1988, Item #1070 Dirty Dunk Laundry Shoot.

*Primary Examiner*—Paul E. Shapiro

*Attorney, Agent, or Firm*—Browdy and Neimark

[57] ABSTRACT

A multipurpose combination frame structure integrally adapted for use as a clothes stand, height measuring instrument and a small basket goal stand for kids, characterized in that it can be assembled and disassembled in a ready manner. The base of the frame is made of two orthogonally joined oblong boards with four side supporting rods slopedly attached thereto; and the vertical stand includes three detachable sticks joined together by bolts and nuts end to end. A backboard is secured at the top of the stand with a dartboard like article disposed at the center thereof. A long basket net is hung from the backboard and is either used as a goal for basketball game or as a disposal container for the laundry.

4 Claims, 3 Drawing Sheets

COMBINATION MULTIPURPOSE FRAME STRUCTURE

FIELD OF THE INVENTION

The present invention relates to a multipurpose frame structure adapted for use as a clothes stand, height measuring instrument and a basketball goal stand especially for kids; the combinational frame of the present invention is characterized in its structural simplicity and ease of assembly and disassembly and multipurpose functions.

It has been the trend in designing a new market product, to combine as many functions as possible in one single article, so that people can employ the article readily in daily life.

To provide children with safe and interesting toys is a major concern of parents everywhere. If the toys can be educative, sportive and useful in daily life, they will meet most of the parents' requirements.

The inventor of the present invention has noticed the requirements and worked out a multipurpose frame structure for kids to use in everyday life.

SUMMARY OF THE INVENTION

Therefore, the primary object of the present invention is to provide a combination multipurpose frame structure which can be used as a clothes stand, height measuring instrument and a basketball goal stand wherein the vertical stand is made of three detachable sticks joined end to end, and a backboard is secured at the top end of the stand with a dartboard-like article disposed at the center thereof, and a basket net attached to a hoop at the bottom of the backboard. On the vertical stand there is a series of scale marks set for easy measurement of kids' physical heights. A number of spaced hanging sticks are disposed on one side of the upright stand so that clothes can be hooked thereon.

One other object of the present invention is to provide a combination multipurpose frame structure which can be assembled and disassembled with ease and transported in a ready manner.

One further object of the present invention is to provide a combinational multipurpose frame structure which can be utilized as sporting instrument for basketball and dart games.

DETAILED DESCRIPTION OF PREFERRED EMBODIMENT

Figure 1:
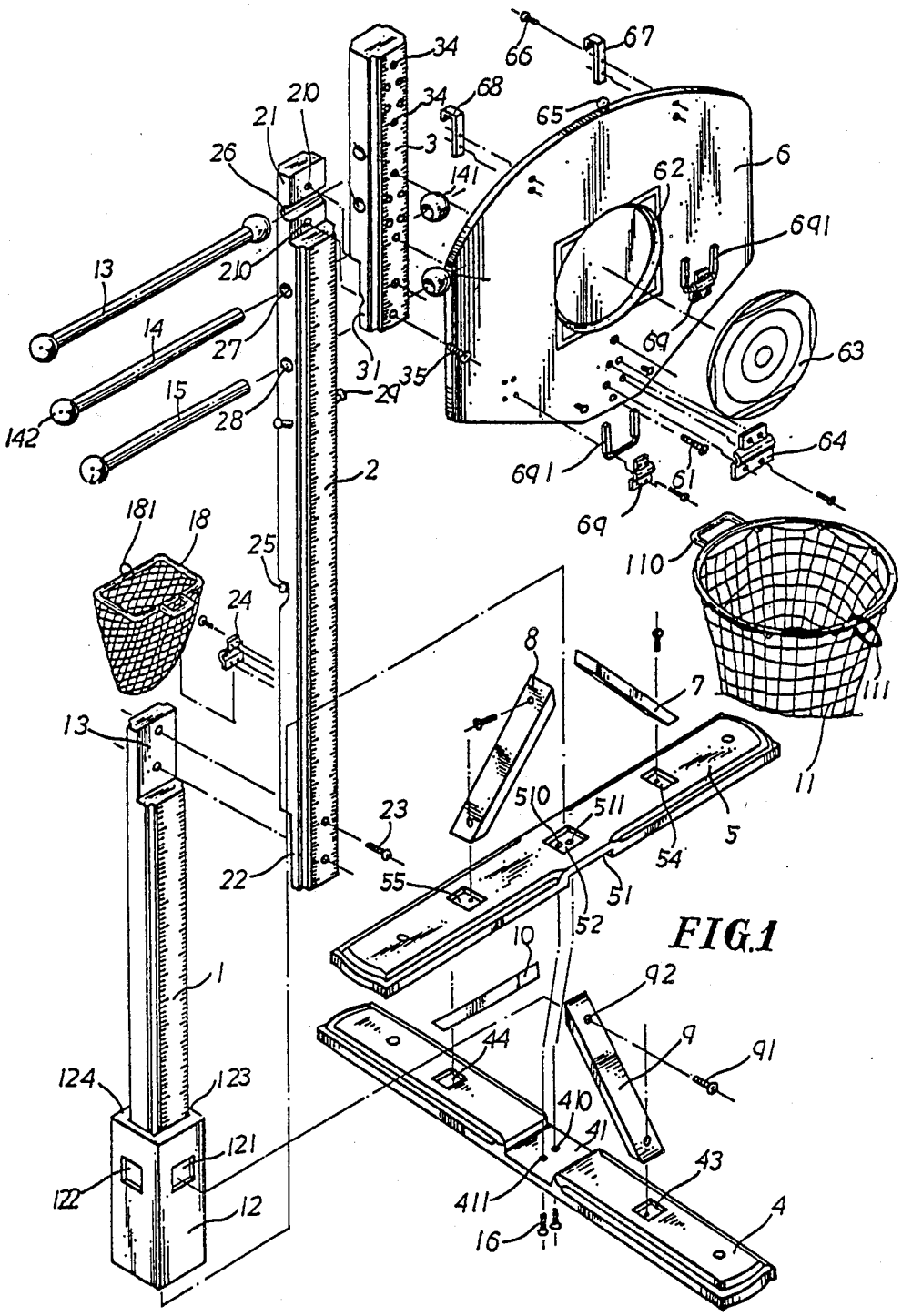
FIG. 1 is a perspective view of the exploded frame structure of the present invention.
Figure 2:
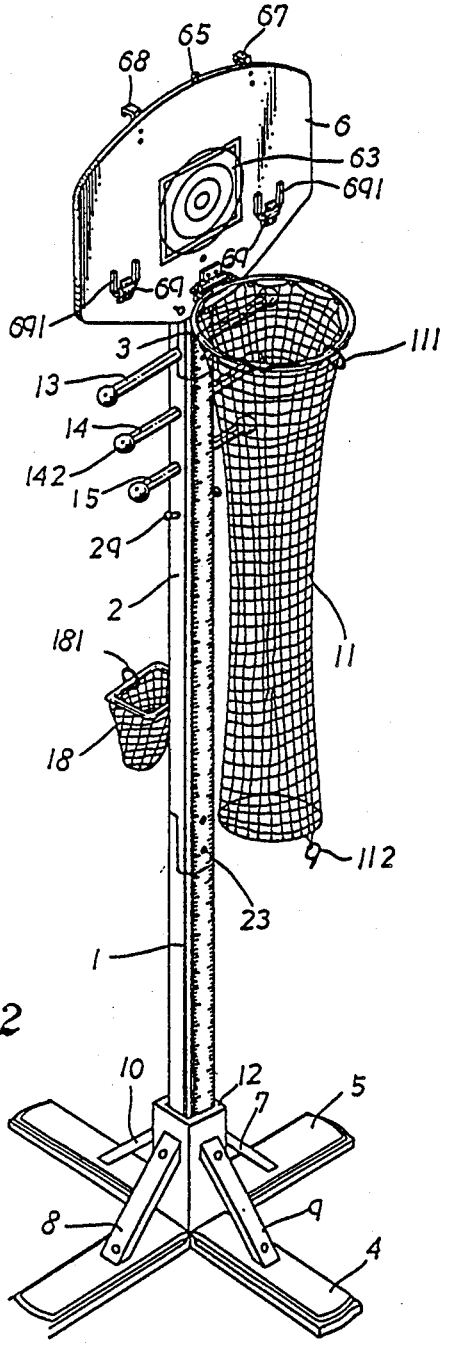
FIG. 2 is a perspecitve view of the assembled frame structure of the present invention.
Figures 3, 4:
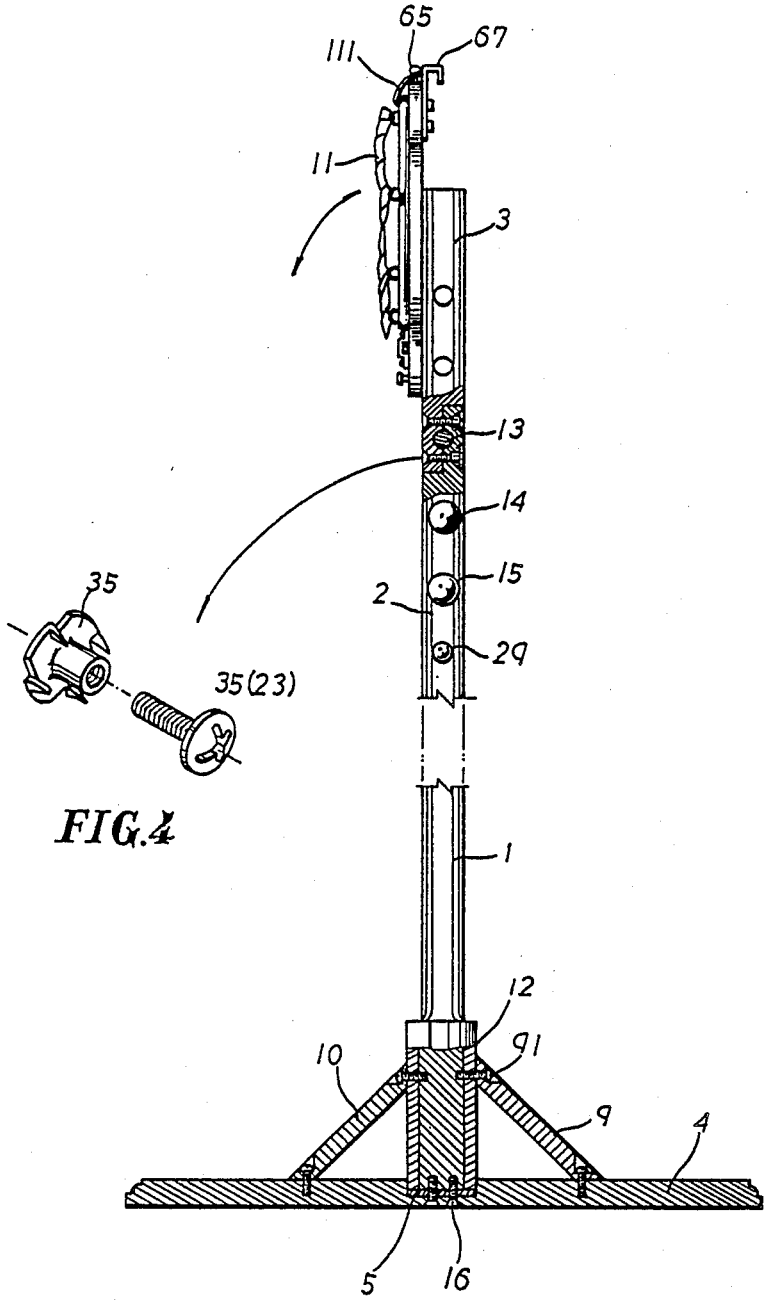
FIG. 3 is a cross sectional view of the present invention.
FIG. 4 is a diagram showing the locking means employed in joining the vertical sticks together.

As shown in FIG. 1, the present multipurpose frame structure comprises a lower stick 1, a middle stick 2 and an upper stick 3 that are joined end to end by bolt means 35 as shown in FIG. 4 to constitute a vertical stand. A pair of orthogonally disposed oblong boards 4, 5 each having a recessed groove 41, 51 respectively formed at the middle thereof are located with the grooves facing to and engaged with each other. Four inclinedly disposed side supporting rods 7, 8, 9, 10 are used to fix the bottom portion 12 of the lower stick 1 firmly in place, which is made larger in size than the lower stick and to have a square cross section with four side walls thereof provided with square recesses 121, 122, 123, 124 so that one end of the side supporting rods 7, 8, 9, 10 can be located therein. On the pair of oblong boards 4, 5, there are disposed a couple of symmetric recesses 43, 44, 54, 55 respectively in which the other end of the side supporting rods are placed.

A backboard 6 is secured to the upper stick 3 with a long basket net 11 attached to the bottom end thereof so that the laundry can be disposed therein: Hanging sticks 13, 14, 15 are disposed spacedly on the upper portion of the middle stick 2 by guiding the same through the respective through holes 26, 27, 28, and each end of the sticks are attached with a round cap such as those 141, 142, thereby clothes can be hung thereon.

In FIG. 3, at the underside of the bottom portion 12 there is disposed a protrusion rod not shown which is vertically engaged with a concavity 52 of the oblong board 5 by means of a bolt 16 which is led through the threaded holes 410, 411, 510, 511 and a threaded hole on the protrusion rod 17 for fixing the bottom portion 12 in place.

The side supporting rods 7, 8, 9, 10 are inclinedly attached to the bottom portion 12 by means of bolts; for instance, screws 91 are led through the holes 92 and fixedly engaged with the recesses 121 and 55 so that the side supporting rods 7, 8, 9, 10 can be firmly fixed in place.

Referring to FIG. 1, the front surface of the lower, middle and upper sticks are provided with scale marks so that the stand can serve as a height measuring instrument for kids. On the rear side of the middle stick 2, at a proper position thereof, there is disposed a C-shaped hook 24 for the attachment of a small basket 18 having a ring element 181 to engage with the hook 24 so that the basket 18 can be removably attached thereon. As shown in FIG. 1, the rear side of the middle stick 2 is provided with a fixed engaging means 25 by which the hook 24 can be pivotally secured; and in the basket small articles, such as calculator or walkman radio can be placed.

To join the lower stick 1, middle stick 2 and upper stick 3 together end to end, the corresponding end of the sticks are provided with flat cuts 21, 31 on which a pair of holes 210 are disposed as to permit the application of bolts and nuts 35 thereto. Similarly, the flat cuts 13 and 22 at the opposite end of the middle stick 2 are furnished with holes so to permit the application of bolts and nuts 23 as shown in FIG. 4.

The backboard 6 is detachably secured to the flat cut 21 of the middle stick 2 by means of bolts 61 which is applied to the stick 2 through the holes 210, or can be variably fixed to the upper end of the upper stick 3 through holes 34. At the center of the backboard is disposed a circular opening 62 with which a dartboard 63 made of cork material can be engaged, permitting people to engage in the dart game.

To attach the long basket net 11 to the backboard 6, there is provided with a hook member 64 with which a C-shaped hanging ring 110 disposed along the periphery of the basket 11 can be detachably engaged. A flexible noose 111 is placed around the neck of the basket net 11 and can also be engaged with a protrusion rod 65 disposed at the top of the backboard 6 when the basket net 11 is not in use, as shown in FIG. 3. The bottom of the basket net 11 is provided with a pull cord 112 which can be tightened to permit the laundry to be disposed therein or be loosened when used as a goal for a basketball game.

A pair of hooks 67, 68 are secured to the back of the backboard 6 by bolts 66 so that the backboard 6 when detached from the stand can be detachably fixed to a wall or door for particular use. On the front side of the backboard 6, a pair of fixing members 69 are symmetrically disposed with a C-shaped hook 691 attached thereto respectively, thereby clothes can also be hanged to the backboards 6. Furthermore, on one side of the middle stick 2, a protrusion hook 29 is disposed for the hanging of key chains, necklaces or the like.

What I claim is:

1. A combination multipurpose frame structure adapted for use as a clothes stand, height measuring instrument and a basketball goal stand comprising:

a vertical stand including:

a lower stick;

a middle stick; and an upper stick;

which are separably associated with each other end to end in consecutive order;

a pair of oblong boards orthogonally joined together by bolt means disposed at the bottom of the stand as a base;

four side supporting rods each inclinedly secured to said oblong boards with one end and the other end thereof fixed to the bottom of said lower stick in a symmetric manner;

said bottom of the lower stick is defined to have larger size than the lower stick itself and having a square cross section with a recess disposed on the wall thereof;

a backboard having a circular opening disposed at the center thereof so that a dartboard can be attached thereto;

a long basket net removably secured to said board and used as a basketball goal or as a disposal container for the laundry;

a basket removably attached to the rear side of said middle stick for the accommodation of small articles;

a number of hanging sticks disposed through holes placed on said upper and lower sticks so that clothes can be hanged thereon.

2. A combination multipurpose frame structure as claimed in claim 1 wherein said upper, middle and lower sticks are provided with scale marks on the front side thereof so that the assembled stand can be employed as a height measuring instrument.

3. A combination multipurpose frame structure as claimed in claim 1 wherein the long basket net is provided with a pull cord at the bottom thereof so that the bottom can be selectively closed or opened, and with a C-shaped hanging ring disposed along a top ring of the basket net.

4. A combination multipurpose frame structure as claimed in claim 1 wherein said backboard is provided with a protrusion rod at the top edge thereof so that said long basket net can be hung on the back of the backboard, and a noose disposed along the mouth of said basket net.

* * * * *